US006447138B1

(12) United States Patent
Yang

(10) Patent No.: US 6,447,138 B1
(45) Date of Patent: Sep. 10, 2002

(54) DECORATIVE AQUARIUM WITH WATER DANCE EFFECT

(76) Inventor: Freddie Yang, 2211 E. 27$^{th}$ St., Vernon, CA (US) 90058

( * ) Notice: Subject to any disclaimer, the term of this patent is extended or adjusted under 35 U.S.C. 154(b) by 0 days.

(21) Appl. No.: 09/792,535

(22) Filed: Feb. 23, 2001

(51) Int. Cl.$^{7}$ ..... F21V 33/00

(52) U.S. Cl. ..... 362/96; 362/101; 362/86; 362/318

(58) Field of Search ..... 362/101, 806, 362/318, 96; 119/254

(56) References Cited

U.S. PATENT DOCUMENTS 5,951,146 A * 9/1999 Lin ..... 362/252
5,967,639 A * 10/1999 Shih ..... 362/96
5,993,021 A 11/1999 Lin
6,135,604 A * 10/2000 Lin ..... 362/96
6,241,359 B1 * 6/2001 Lin ..... 362/96

FOREIGN PATENT DOCUMENTS

JP 8077807 1/1996
JP 10085460 9/1997

* cited by examiner

*Primary Examiner*—Thomas M. Sember
(74) *Attorney, Agent, or Firm*—Intellectual Property Law Group LLP; Otto O. Lee; Takashi Hashimoto

(57) ABSTRACT

The present invention discloses a new decorative aquarium with water dance effect comprising an air pump, multiple light emitting sources, and a music source that generates variable melodies of music, in which an amount of air pumped out by an air pump and the colors of light emitted by light sources can be varied with the melody of music. Therefore, the user can at the same time listen to the music and watch the water dance to enjoy both audio and visual effects.

8 Claims, 5 Drawing Sheets

DECORATIVE AQUARIUM WITH WATER DANCE EFFECT

BACKGROUND

This invention relates generally to aquariums, and specifically, to a decorative aquarium with water dance effect, in which the intensity of the bubbles and colors of light are controlled by, and varied with, the melody of a music so as to achieve both visual and audio entertaining effect.

A conventional decorative aquarium includes a case and a base seat for protecting the case. Partitioning boards are disposed in the case at a certain height to divide the case into multiple chambers. A pump, a thermostat, a filter, and a fish tank are placed in the chambers. A viewing board, which can be a mirror or a board material that is designed and modified by a user, is arranged above the partitioning boards. A bottom rack is disposed under the viewing board. Such conventional decorative aquarium can achieve a decorative effect. However, the case is shallow and narrow that fish may jump out of the case.

Another conventional decorative aquarium, as may be disclosed by Wen-Yung Lin in his "Decorative Lamp in Aquarium Tank," U.S. Pat. No. 5,993,021 ("'021 patent"), illustrates an attempt to improve upon the aforementioned conventional decorative aquarium. Such decorative aquarium has a transparent tubular main body containing a liquid, an air pump being disposed on the bottom thereof, and fake fish that floats in the liquid. However, the fake fish can only move along a fixed path of the bubbles generated by the air pump, and such decorative aquarium does not appear realistic.

Yet another conventional decorative aquarium illustrates an attempt to improve upon the aforementioned conventional decorative aquarium. In his "Submerged Luminaire" patent, Japanese Patent No. 8077807 ("JP '807 patent"), Norihiro Shinya discusses a submerged luminaire having various lighting effects for lighting from inside a water tank and having stereoscopic effect. Such luminaire consists of a light source and an optical fiber light guide coupled at an incident end to the light source and an outgoing end is arranged in the water tank. The outgoing end is arranged in a line and is adjacent to an air diffuser having bubble generating holes and the outgoing end and the air diffuser are is integrally formed by an integral member. An air compressor is connected to the air diffuser through an air pipe and compressed air is fed from the compressor. However, the lighting effect, at most, is coordinated with the generated air bubbles and not with any other effect, such as a melody of music.

Yet another conventional decorative aquarium, as may be disclosed by Hitoshi Ando in his Japanese Patent No. 10085460 ("JP '460 patent"), entitled "Air Bubble Generator by Musical Sound," illustrates another attempt to improve upon the aforementioned conventional decorative aquarium. Ando's air bubble generator is provided with a water tank housing a liquid and provided with multiple air bubble generation ports, an air bubble generation mechanism for generating air bubbles from multiple air bubble generation ports, and a control part for controlling the air bubble generation mechanism corresponding to musical sound information and controlling the generation of the air bubbles from the air bubble generation ports. The air bubbles are generated from the air bubble generation ports corresponding the musical sound information. However, Ando's air bubble generator lacks additional decorative effect such as lighting effect that is also coordinated with the musical sound information.

Therefore, it is a primary object of the present invention to provide a decorative aquarium with water dance effect. The decorative aquarium can be switched into a sonic frequency-controlled mode in which the intensity of the bubbles and colors of light are controlled by, and varied with, the frequency of music.

Further object of the present invention is to provide the above decorative aquarium by which a user can at the same time enjoy the music and watch the water dance for both visual and audio pleasures.

SUMMARY

The present invention satisfies these needs.

The decorative aquarium with water dance effect of the present invention comprises a transparent main body, a base seat, a controlling circuit, a single chip, an electrical air pump, and multiple light emitting sources. The transparent main body, detacheably engages the base seat for support. The single chip, the electrical pump, and the light emitting sources are connected to the controlling circuit, and they are disposed in the base seat. The amount of air and the rate of discharge of the air pumped out by the air pump, as well as the color of light emitted by the light emitting sources can be varied according to the music melody generated by the single chip to create the water dance effect.

The controlling circuit may further include a controlling switch for activating the decorative aquarium into a water dance effect mode to produce such water dance effect. Therefore, a user can simultaneously enjoy the music and watch the water dance for both visual and audio pleasures.

The controlling circuit may further include a controlling switch capable of switching the decorative aquarium into a common function mode to disable the water dance effect, in which case the size, and the discharge rate of air pumped out by the air pump, and the flickering color of light emitted by the light emitting sources remain constant.

In another embodiment of the present invention, the main body further comprises a plurality of floating decorative articles located therein for further visual entertainment effect.

In yet another embodiment of the present invention, the light emitting sources are vertically placed in the base seat.

DRAWINGS

These and other features, aspects, and advantages of the present invention will become better understood with regard to the following description, appended claims, and accompanying drawings where:

DETAILED DESCRIPTION OF THE INVENTION

Figure 1:
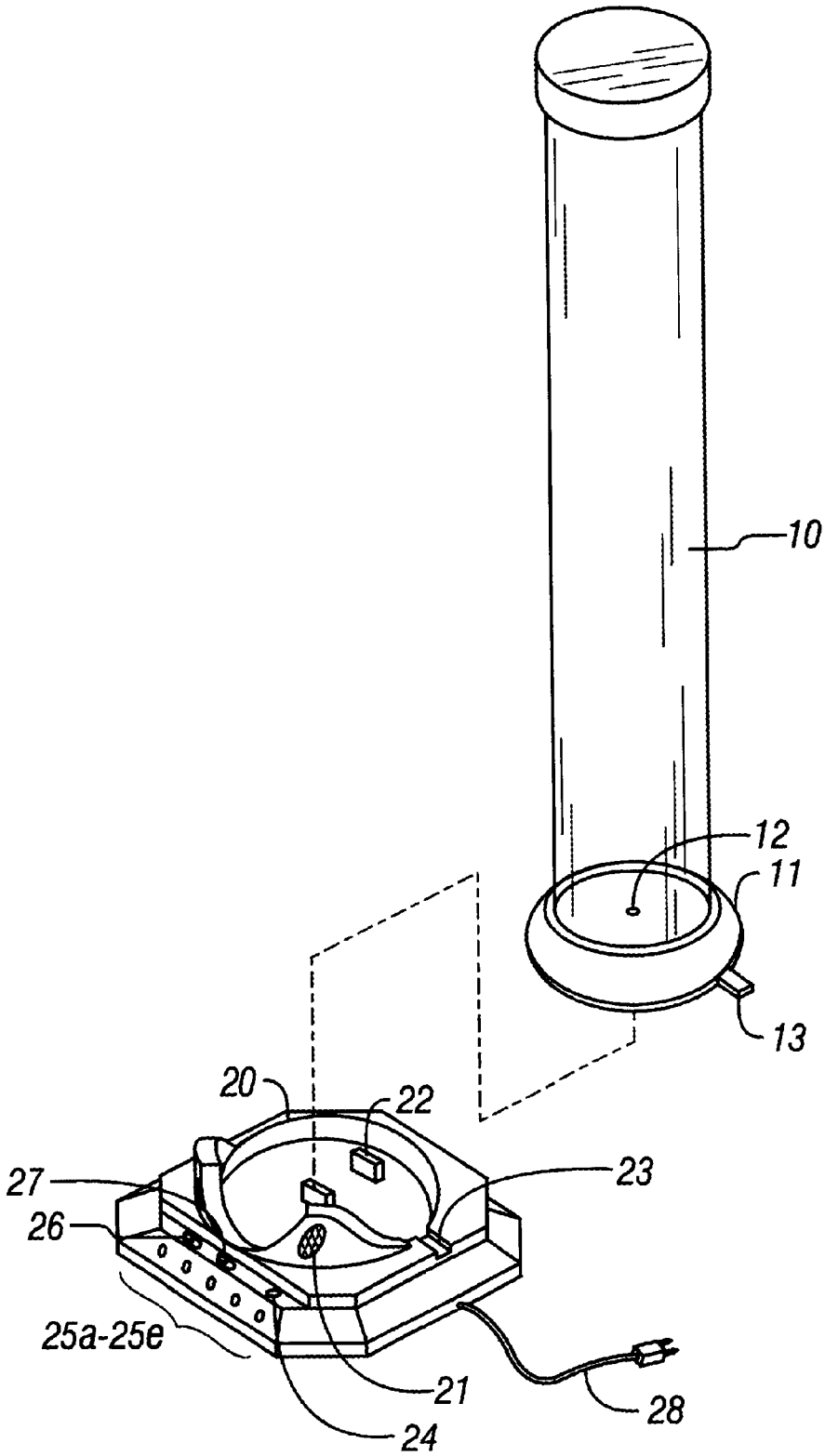
FIG. 1 is a perspective exploded view of a preferred embodiment of the present invention.
Figure 2:
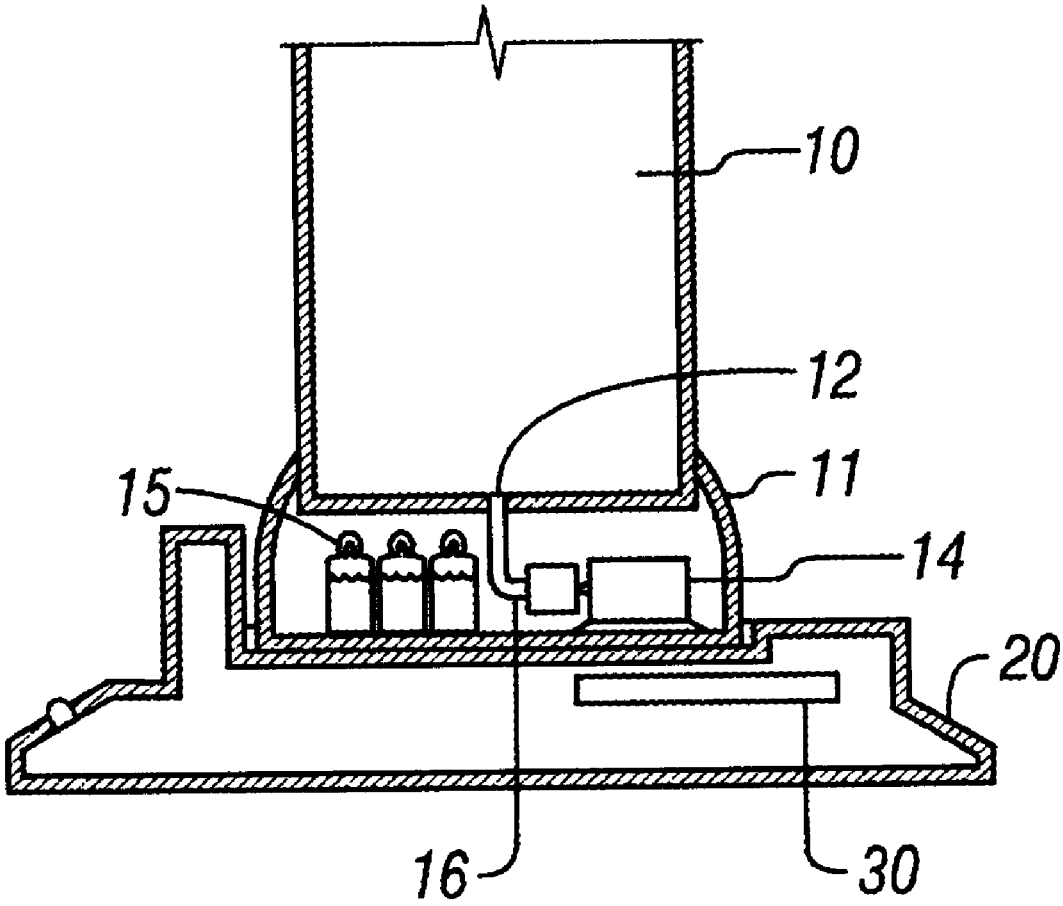
FIG. 2 is a sectional assembled view of a preferred embodiment of the present invention.

Referring to FIGS. 1 and 2, the decorative aquarium of the present invention, the decorative aquarium of the present invention includes a transparent main body 10, a base case 20 and a controlling circuit 30 installed in the base case 20. The transparent main body 10 is preferably made out of a transparent tube with a certain length, and it is filled with a liquid. The bottom of the main body 10 engages a base seat 11. Two locating blocks 13 are respectively formed on two opposite sides of the base seat 11. Multiple light emitting sources 15 with different colors, such as red, blue and green, and an air pump 14 are disposed in the interior of the base seat 11. The outlet of the air pump 14 via a communicating pipe 16 is connected to a through hole 12 of the bottom of the main body 1.

The top face of the base case 20 is formed with a receptacle 22 with a shape corresponding to that of the base seat 11 of the main body 10. Two opposite sides of the receptacle 22 are formed with locating channels 23, to which locating blocks 13 are engaged for stabilizing the main body 10 to the base seat 11. Two speakers 21 are mounted on two sides of front face of the base case 20. Two switches 26, 27, a socket 24 and five function keys 25*a* through 25*e* are disposed under the speakers 21. The switches, socket and function keys are electrically connected with the controlling circuit 30 in the base case 20. A power wire 28 extends from the controlling circuit 30 out of the base case 20.

Figure 3:
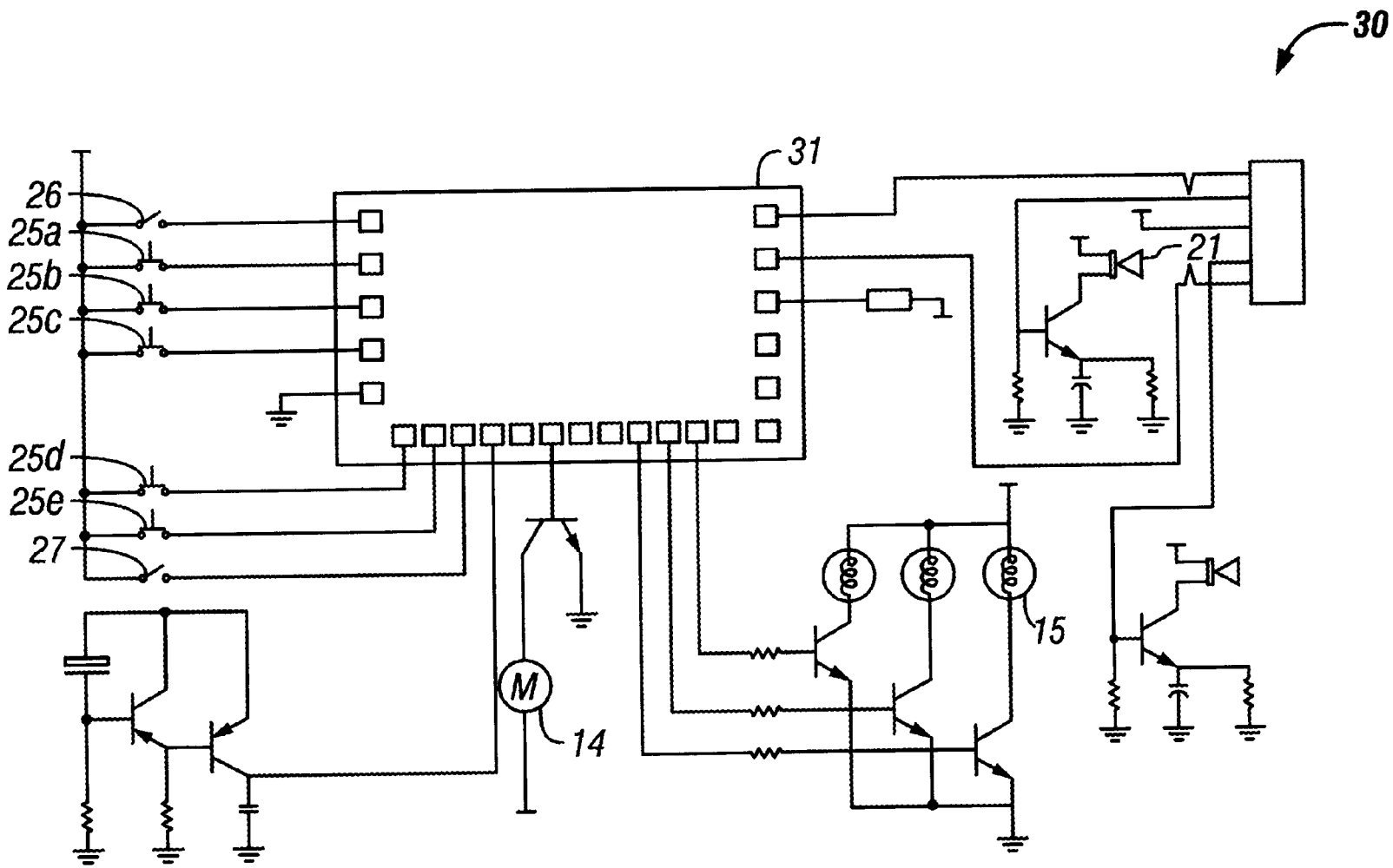
FIG. 3 is a circuit diagram of the controlling circuit of a preferred embodiment of the present invention.

FIG. 3 is a circuit diagram of the controlling circuit 30. The controlling circuit 30 includes multiple transistors, resistors, capacitors, and a single chip 31 having at least one random access memory, in which a controlling program is stored. The two switches 26 and 27 are respectively connected with the tenth and twenty-second pins of the single chip 31. The five function keys 25*a* through 25*e* are respectively connected with the eleventh, twelfth, thirteenth, twentieth and twenty-first pins. The socket 24 is connected with the twenty-fifth pin to form the controlling circuit.

After powered on, the present invention has two options: (1) a common function mode and (2) a water dance function mode.

Option 1—Common function mode. The switch 26 is switched off to activate the common function mode. During the common function mode, the rate of discharge of the air bubbles from the air pump 14 is continuous and constant. The light emitting sources 15 are all switched on or off. By means of the switch 27, a set of built-in music melodies that are stored in the random access memory of the single chip 31 can be selected for play. By means of the press key 25*a*, a single builtin melody can be selected to be played. Alternatively, by means of the press key 25*b*, multiple built-in melodies can be played in sequence. By means of the press keys 25*c* and 25*d*, the volume of the music can be adjusted. By means of the press key 25*e*, the music can be stopped while the bubbles are still continuously discharged.

Option 2—Water dance function mode. The switch 26 is switched on to activate the water dance function mode. The rate of discharge of air bubbles from the air pump 14 and the operation of the light emitting sources 15 are entirely determined by the melody of the music. Therefore, when different melodies are selected via the switch 27, press key 25*a*, or press key 25*b*, the air pump 14 and the light emitting sources 15 will be controlled accordingly to create a unique water dance pattern.

Figure 5:
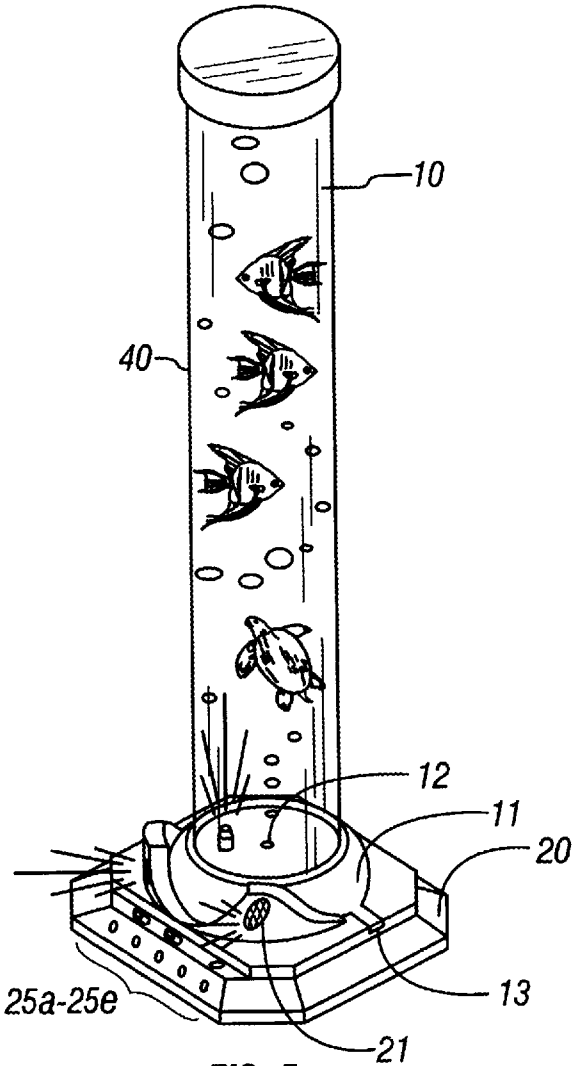
FIG. 5 shows the operation of a preferred embodiment of the present invention in another state.
Figure 4:
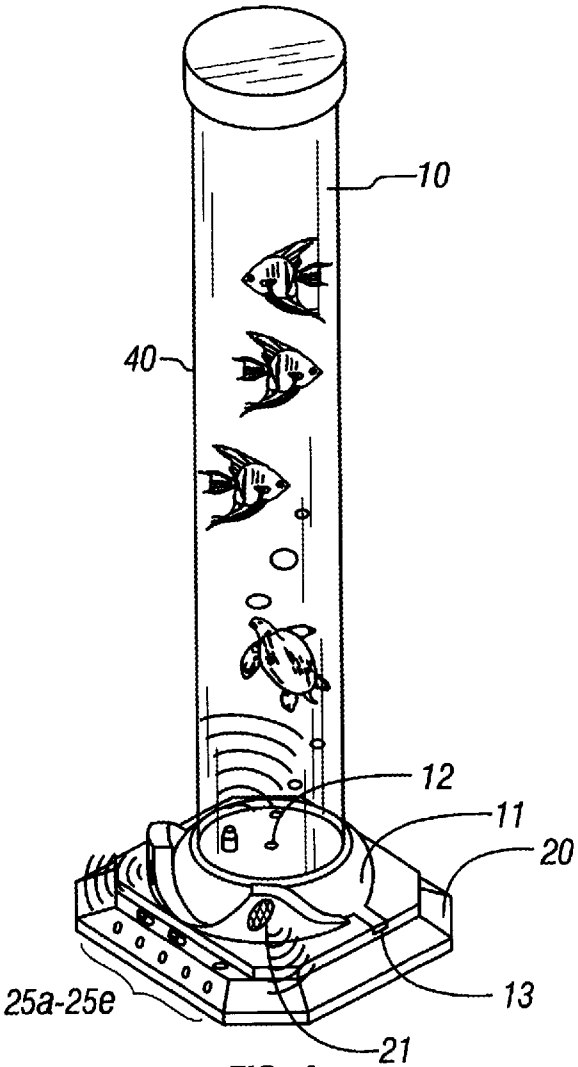
FIG. 4 shows the operation of a preferred embodiment of the present invention in one state.

In addition, fake water fowls 40 can be placed in the transparent main body 10 as shown in FIG. 4. The air pump 14 can pump bubbles into the main body for the fake water fowls 40 to float therein. In to addition, as shown in FIG. 5, when the switch 26 is switched to water dance function mode, the fake water fowls 40 can freely and lively float in the liquid with patterns varied with the frequency of the music. Moreover, in cooperation with sound and light effect, a visual and audio entertaining effect can be achieved.

Figure 6:
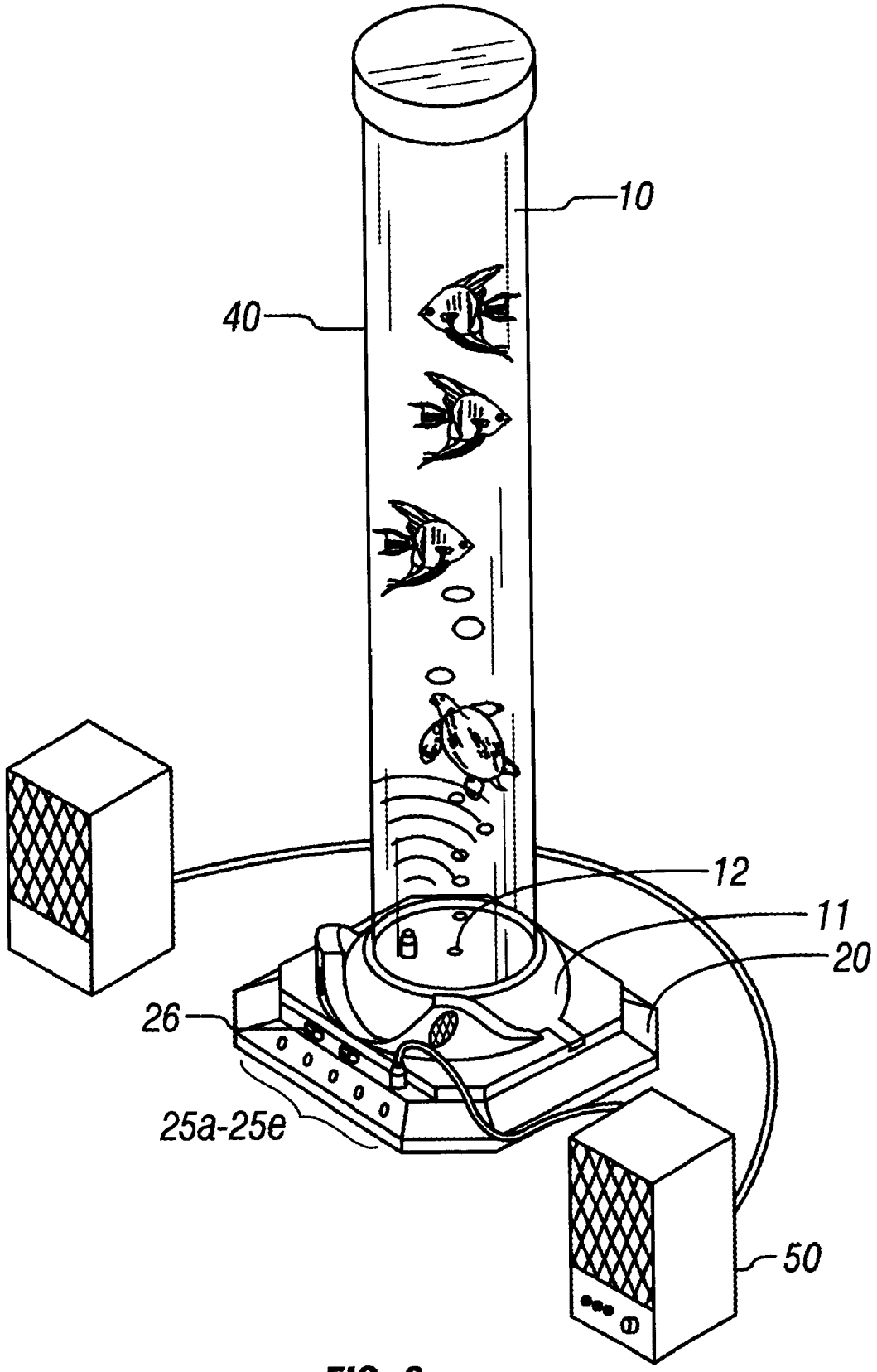
FIG. 6 shows a set of speakers being externally connected with a preferred embodiment of the present invention.

As shown in FIG. 6, a user may choose to connect speakers 50 externally to the socket 24 to produce music with higher power output, in case speakers 21 that are built in the base case 20 does not produce adequate music power output for the user, and the user desires amplification of the music via use of powered speakers such as speakers 50. For instance, the user may elect to connect the present invention to a set of elaborate audio system capable of producing surround sound effect to enjoy the music produced by the present invention with three-dimensional sound effect. Or, the user may choose to connect a subwoofer for better bass sound quality of the music produced by the present invention.

In sum, according to the decorative aquarium of the present invention, the amount of the bubbles and the flickering light can be controlled by the melody of the music produced by the single chip 31. Therefore, when enjoying the music, a user can watch the floating decorative articles including artificial water animals such as fake water fowls 40 and the colorful light varied with the melody at the same time, resulting in a novel decorative effect.

The above embodiments are used only to illustrate the present invention, and it is not intended to limit the scope thereof. A person skilled in the art will readily recognize similar variations and alternative embodiments of the present invention, without departing from the spirit of the present invention.

What is claimed is:

1. A decorative aquarium with a water dance effect, comprising:

(a) a substantially rigid transparent main body filled with a liquid; wherein the main body comprises a plurality of floating decorative articles;

(b) a base seat being detachably engageable with the transparent main body for supporting the transparent main body;

(c) a single chip that generates and processes a plurality of control signals, the control signals comprising:

i) a plurality of audio signals, ii) a plurality of bubble signals, and iii) a plurality of light signals;

(d) a controlling circuit connected to the single chip for transmitting the control signals to:

i) an electrical air pump electronically connected to the controlling circuit and being controlled by the bubble signals;

ii) a plurality of light emitting sources located in the base seat and electronically connected to the controlling circuit, the light emitting sources being controlled by the light signals;

iii) one or more speakers electronically connected to the controlling circuit, the speakers being capable of reproducing at least one melody of music based on the audio signals; and (e) a power source for providing electric power to the decorative aquarium;

whereby an amount of air pumped out by the air pump, one or more colors of light emitted by the light emitting sources, and a floating pattern of one or more of the floating decorative articles can be varied according to the control signal generated by the single chip to correspond to the melody of the music based on the audio signals to create the water dance effect.

2. The decorative aquarium of claim 1, wherein the controlling circuit further comprises a controlling switch capable of switching the decorative aquarium into a water dance effect mode to create the water dance effect.

3. The decorative aquarium of claim 1, wherein the controlling circuit further comprises a controlling switch capable of switching the decorative aquarium to a common function mode to disable the water dance effect.

4. The decorative aquarium of claim 1, wherein the controlling circuit further comprises a plurality of function keys which allows an user to select a melody of music from a predetermined set of music melodies processed by the single chip.

5. The decorative aquarium of claim 1, wherein the light emitting sources are vertically placed in the base seat.

6. The decorative aquarium of claim 1, wherein the light emitting sources emit light of different colors.

7. The decorative aquarium of claim 1 further comprising one or more external speakers.

8. The decorative aquarium of claim 1, wherein the single chip is upgradeable.

* * * * *